United States Patent [19]

Rivere

[11] 3,931,814

[45] Jan. 13, 1976

[54] CYLINDER-INDUCTION RESPONSIVE ELECTRONIC FUEL FEED CONTROL CARBURETORS

[75] Inventor: Jean-Pierre Rivere, Billancourt, France

[73] Assignees: Regie Nationale des Usines Renault, Billancourt; Automobiles Peugeot, Paris, both of France

[22] Filed: Aug. 27, 1973

[21] Appl. No.: 391,796

[30] Foreign Application Priority Data

Sept. 28, 1972 France ..... 72.34360

[52] U.S. Cl. ..... 123/119 R; 261/DIG. 74; 123/139 AW

[51] Int. Cl.[2] ..... F02B 33/00

[58] Field of Search.... 123/32 EA, 119 R, 139 AW, 123/139 E, 32 AE

[56] References Cited

UNITED STATES PATENTS

| | | | |
|---|---|---|---|
| 806,822 | 12/1905 | Millard | 261/DIG. 74 |
| 2,791,995 | 5/1957 | Dietrich | 261/DIG. 74 |
| 3,548,792 | 12/1970 | Palmer | 123/119 R |
| 3,618,581 | 11/1971 | Simonet | 261/DIG. 74 |
| 3,778,038 | 12/1973 | Eversole | 123/119 R |
| 3,800,766 | 4/1974 | Schubeck | 123/119 A |

FOREIGN PATENTS OR APPLICATIONS

| | | |
|---|---|---|
| 1,476,237 | 0000 | Germany |

*Primary Examiner*—Wendell E. Burns
*Assistant Examiner*—Paul Devinsky
*Attorney, Agent, or Firm*—Stevens, Davis, Miller & Mosher

[57] ABSTRACT

Electronic-control carburetor adapted to emulsify a metered amount of fuel in synchronism with the induction phases of the cylinders of an internal combustion engine, which comprises a double sonic venturi system providing a low loss of pressure and supplied under the control of an electromagnetic valve in synchronism with the induction phases of the cylinders.

6 Claims, 3 Drawing Figures

CYLINDER-INDUCTION RESPONSIVE ELECTRONIC FUEL FEED CONTROL CARBURETORS

The present invention relates to an electronically controlled carburetor wherein a metered amount of fuel is emulsified in synchronism with the induction of the engine cylinders, the fuel feed being discontinued outside the induction phases.

Electronic-controlled carburetor are already known wherein the fuel penetrating into a constant-level cistern or float chamber is sucked through an emulsion tube together with a stream of primary air, the fuel output from the float chamber being adjusted by a needle valve responsive to an electronic device as a function of the engine speed. This arrangement, notwithstanding the increased sensitivity and quickness of response inherent to electronic control system, cannot eliminate the inconveniences characterizing the operation of the carburetor proper, such as lack of homogeneity and the risk of unpriming due to fuel vapour lock. Besides, in these known systems the problems arising in connection with the idling adjustments remain unsolved, notably as far as the homogeneity of the air/fuel mixture is concerned.

On the other hand, an injection fuel-feed system is known through the U.S. patent application Ser. No. 235.154 of Mar. 16, 1972, wherein an arrangement is disclosed for injecting fuel under electronic control means into each cylinder through a twin sonic nozzle imparting a high degree of homogeneity to the mixture due to the high suction speed of the gaseous flow. This solution is intended more particularly for racing engines and is inherently expensive in more popular applications, due to the use of electronic technical devices.

It is the essential object of the present invention to provide a carburetor of the type comprising electronic means for controlling the fuel feed from the carburetor and having in a more economical form all the advantageous features of the above-mentioned electronic injection device.

The carburetor according to this invention comprises in a manner known per se a constant-level float chamber or cistern delivering fuel to an emulsion tube receiving primary air from the air intake, said emulsion tube opening in turn into the neck of at least one central venturi of a double venturi or choke carburetor body. It is characterized in that the inlet of the emulsion tube is controlled by means of at least one electromagnetically operated valve embedded in the bottom of the float chamber and that the carburetor body consists of a sonic-type, low pressure-loss type, double-venturi choke, said electromagnetic valve being responsive to an electronic device whereby the fuel is fed in synchronism with the induction of the engine cylinders.

This feed system is conducive to a particularly simple carburetor construction. In comparison with conventional carburetors, the direct metering of fuel eliminates any priming problems and troubles, as well as the problems of progressiveness in the fuel vaporization. It is free of any auxiliary idling feed circuit. In comparison with injection systems, the system of the present invention ensures a better atomization due to the provision of the twin sonic chokes, on the one hand, and to the supply of fuel in phase with the cylinder induction, thus providing a simple yet efficient solution to the problems of distributing the air/fuel mixture to said cylinders.

Figures 1, 2:
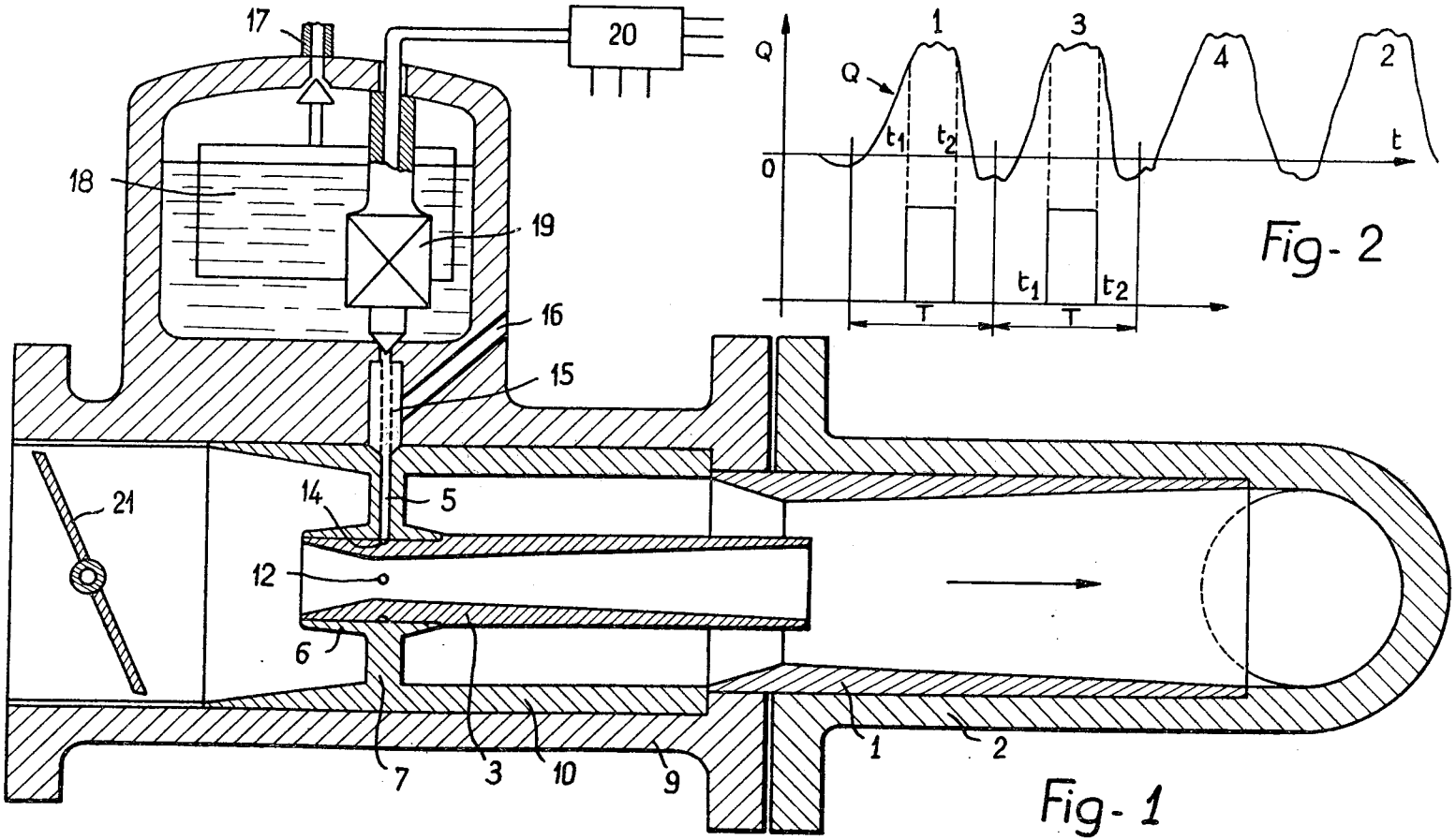
FIG. 1 illustrates in axial section a carburetor according to this invention.
FIG. 2 is a diagram plotting the curve of the mass output of air sucked by each cylinder in succession, in the case of a four-cylindered engine.

Referring first to FIG. 1, it will be seen that the body 9 of the carburetor is mounted to the induction manifold 2 and encloses the sonic choke or venturi tube 1 and a central diffuser venturi 3 fitted in the supporting socket 6 connected to the venturi carrier tube 10 by means of a pair of radial arms 7, so that the concentric outer groove 14 of said central venturi, which acts as a feed channel, is coincident with the radial feed passage 5. The primary mixture from the emulsion tube 15 supplied with air through an oblique air inlet hole 16 penetrates into the diffuser venturi 3 through radial holes 12.

The fuel from the fuel tank (not shown) flows through a feed pipe 17 into the constant-level or float chamber 18 in which an electromagnetic valve 19 controls the fuel suction towards the emulsion tube 15. The opening time and frequency of this valve are controlled by an electronic computer 20 in synchronism with the induction phases of the engine cylinders, as shown in the diagram of FIG. 2, wherein the curve denoting the mass output of air sucked by each cylinder in succession is shown in the case of four-cylindered engine (1, 2, 3, 4) in the firing order 1, 3, 4, 2 which of course is also the induction phase order.

In FIG. 2 the lower abscissa line denotes the amounts of fuel sucked during the opening periods of valve 19 : $t_2 - t_1 = \Delta t$. These periods are shorter than, or at the most equal to the induction phase T of an engine cylinder and they are regulated by said computer 20 in a conventional manner, as a function of the various parameters governing the engine operation, such as the pressure in the induction manifold or pipe, the mass output of induction air Q, the air water and/or oil temperatures, the engine speed, etc. . . . controlled by the air/fuel proportion.

The electronic computer 20 can thus control the ratio of this air/fuel proportion as a function of the engine load.

This computer 20 may be of the very simplified type currently utilized in the field of electronic fuel injection systems, and controls only the valve 19. For example, the computer may be of the type disclosed in U.S. Pat. No. 3,788,285. That computer, instead of operating the injectors disclosed therein, would actuate the electromagnetic valve 19. The absence of fuel feed pressure, as in injection systems, facilitates the operation of this valve and improves the precision of its adjustment, notably for the quickness of the valve opening and closing movements, the induction facilitating the closing movement while the suction effect interferes somewhat with the opening, due to the moderate cross-sectional area of the valve seat, which is that of passage 5.

The air output is controlled as usual by means of a butterfly valve 21 located upstream of the venturis.

The very short and direct path for the fuel through the single perforated emulsion tube 15, in the absence of any siphon means, ensures a rapid and accurate fuel metering, free of any priming problems. Moreover, the fact that the valve 19 remains closed outside the suction phases eliminates any fuel feed irregularities. Since this valve 19 opens only during the suction or induction phases, the fuel atomization under idling or low-load operating conditions is improved considerably.

The air supply passage 16 is sufficient for delivering idling air, i.e. when the butterfly valve 21 is closed.

The emulsion tube 15 associated with this direct primary air orifice 16 constitutes a chamber capable of efficiently damping out any pressure variations in the manifold 2 at the level of needle valve 19 responsive to electromagnetic control means, so that the necessary corrections of the fuel output by means of the computer 20 are greatly simplified.

According to the fuel output to be supplied, and preferably, a plurality of such valves 19 may be used in lieu of a single, larger valve giving slower response times, these valves having in this case smaller dimensions so that they can easily be accomodated in the float chamber.

Figure 3:
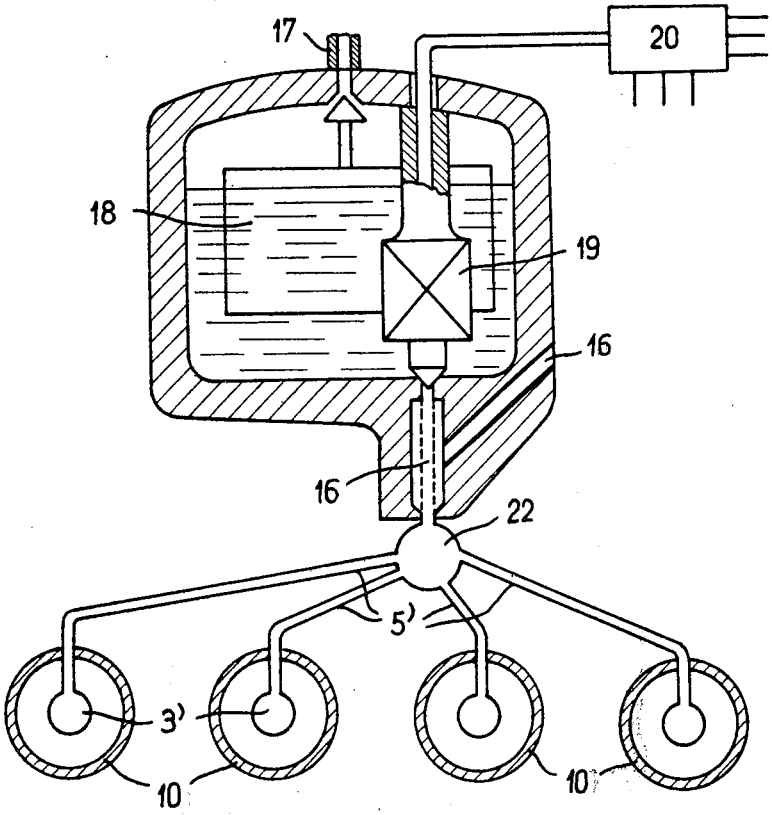
FIG. 3 illustrates a modified form of embodiment comprising a multiple choke-tube arrangement.

The modified form of embodiment illustrated in FIG. 3 is a multiple-choke-tube construction comprising one choke tube per cylinder, wherein the pipes 5' supplying fuel to the central venturis 3' are connected to a common chamber or header 22 at the outlet of the emulsion tube 16. In this example, the vacuum produced in the cylinder performing its induction phase is stronger than that of the other cylinders and causes the mixture to be sucked from chamber 22 into the induction-phase cylinder. The length of these pipes 5' shall be kept as short as possible, as well as the relative spacing of the venturis 10.

This arrangement is characterized not only by a substantial simplification and a satisfactory atomization of the air/fuel mixture distribution, but also by a suitable proportioning of this mixture, thus affording better engine performances.

The device is adaptable to induction manifolds of the type utilized in fuel-injection systems, of which it combines the advantageous features with a greater simplicity and the lower cost of carburetor systems.

Although a specific form of embodiment of this invention has been described herein and illustrated in the accompanying drawings, it will readily occur to those skilled in the art that various modifications and changes may be brought thereto without departing from the scope of the invention as set forth in the appended claims.

I claim:

1. An electronically controlled carburetor for supplying fuel to cylinders of an internal combustion engine, said carburetor comprising:

a float chamber having a single outlet passage, a doubled venturi including a central venturi having a neck, an electromagnetic valve, disposed within the float chamber, for selectively opening and closing the outlet passage, an emulsion tube defining a passage fluidly connecting said outlet passage to the neck of said central venturi, a passage for air connected to said emulsion tube passage, and an electronic computer for opening said electromagnetic valve in synchronism with the induction phase of the cylinders of an internal combustion engine.

2. An electronically controlled carburetor as claimed in claim 1, wherein:

said air passage is the sole means through which the necessary air is supplied for engine idling operation.

3. An electronically controlled carburetor for supplying fuel to cylinders of an internal combustion engine, said carburetor comprising:

a float chamber having a single outlet passage, a double venturi including a central venturi having a neck, an electromagnetic valve, disposed within the float chamber, for selectively opening and closing the outlet passage, an emulsion tube defining a passage fluidly connecting said outlet passage with the neck of the central venturi, and means for opening said electromagnetic valve in synchronism with the induction phase of the cylinders of an internal combustion engine.

4. An electronically controlled carburetor as claimed in claim 3, wherein:

said means comprises an electronic computer.

5. An electronically controlled carburetor as claimed in claim 3, further comprising:

a passage for air connected to said emulsion tube passage, said passage being the sole means through which the necessary air is supplied for engine idling operation.

6. An electronically controlled carburetor as claimed in claim 3, further comprising:

means defining an annular groove in the exterior surface of the neck of the central venturi, means defining a plurality of holes connecting said groove with the interior of the neck of the central venturi, and said emulsion tube passage is fluidly connected to said groove so that fuel from said emulsion tube passage enters said groove and is transmitted to the interior of the neck of the central venturi through said holes.

* * * * *